US010246168B1

(12) United States Patent
Stohler et al.

(10) Patent No.: US 10,246,168 B1
(45) Date of Patent: Apr. 2, 2019

(54) WAKE BOAT TOW ROPE MANAGEMENT SYSTEM

(71) Applicants: Tanya Stohler, Fishers, IN (US); Anthony R. Ebeyer, McCordsville, IN (US)

(72) Inventors: Tanya Stohler, Fishers, IN (US); Anthony R. Ebeyer, McCordsville, IN (US)

( * ) Notice: Subject to any disclaimer, the term of this patent is extended or adjusted under 35 U.S.C. 154(b) by 9 days.

(21) Appl. No.: 15/808,308

(22) Filed: Nov. 9, 2017

(51) Int. Cl.
*B63B 35/73* (2006.01)
*B63B 35/81* (2006.01)

(52) U.S. Cl.
CPC ..... *B63B 35/815* (2013.01)

(58) Field of Classification Search
CPC ..... B63B 35/815; B63B 35/816; B63B 35/73
USPC ..... 114/253
See application file for complete search history.

(56) References Cited

U.S. PATENT DOCUMENTS 4,233,923 A * 11/1980 Casad ..... B63B 21/60 114/252
4,624,141 A * 11/1986 Soleau ..... B63B 35/815 116/26
4,771,722 A * 9/1988 Tihany ..... B63B 1/125 114/343
4,878,449 A * 11/1989 Smith ..... B63B 35/816 114/253
5,927,226 A * 7/1999 Patterson ..... B63B 21/56 114/249
6,055,924 A * 5/2000 Marshall ..... B63B 1/24 114/242
8,336,477 B2 * 12/2012 Walker ..... B63B 35/73 114/125
8,619,496 B2 * 12/2013 Hartland ..... B63B 21/66 114/253
9,731,797 B2 * 8/2017 Paccoud ..... B63B 35/815
2012/0167812 A1 * 7/2012 Walker ..... B63B 35/73 114/124
2012/0279433 A1 * 11/2012 Christensen ..... B63B 35/816 114/253

* cited by examiner

*Primary Examiner* — S. Joseph Morano
*Assistant Examiner* — Jovon E Hayes
(74) *Attorney, Agent, or Firm* — Matthew M. Googe; Robinson IP Law, PLLC

(57) ABSTRACT

A tow rope management system for managing a tow rope attached to a mounting point on a tower of a boat, the tow rope management system includes: a first arm pivotally associated with the tower adjacent the mounting point on the tower of the boat, the first arm pivotable along a horizontal axis between a first stowed position and a second deployed position, the first arm biased towards the first position; an elongate guide member supported adjacent the first arm at a first end of the guide, the guide extending to a second end that is distal from the first arm and mounting point, the elongate guide including a rope support formed at the second distal end of the elongate guide member for supporting the tow rope at the second end of the elongate guide member.

12 Claims, 6 Drawing Sheets

WAKE BOAT TOW ROPE MANAGEMENT SYSTEM

FIELD

This disclosure relates to the field of wake surfing. More particularly, this disclosure relates to a system for managing a tow rope behind a boat during wakesurfing.

BACKGROUND

Wake surfing has emerged as a popular recreational sport. When wake surfing, a person is towed behind a boat or other watercraft with a rope until the person has positioned themselves within a wave behind the boat. Once the person reaches a desired position on a wave behind the boat, the tow rope is then released and typically tossed into the boat when the rope is no longer needed.

When the rope is thrown into the boat, the potential exists for a handle of the rope to strike passengers in the boat, thereby causing injury to passengers in the boat. Further, after a wake surfer falls, the handle must be returned to the wake surfer so that the wake surfer may be subsequently pulled behind the boat. Returning the rope typically requires throwing of the rope and handle towards the user in the water. This also greatly increases the likelihood of striking the wake surfer with the rope and handle and thereby also causing injury.

Maneuvering of the boat to retrieve a downed wake surfer also creates a risk of running over the rope or having the rope and handle become entangled in a prop of the boat. Retrieval of the surfer also requires the boat to pass in close proximity to the wake surfer given the typical short length of the rope for wake surfing.

What is needed, therefore, is an apparatus for managing a tow rope behind a boat to facilitate wakesurfing behind the boat.

SUMMARY

The above and other needs are met by a tow rope management system for managing a tow rope attached to a mounting point on a tower of a boat. In a first aspect, a tow rope management system for managing a tow rope is attached to a mounting point on a boat and includes: a first arm pivotally associated with the boat adjacent the mounting point on the boat, the first arm pivotable along a horizontal axis between a first stowed position and a second deployed position, the first arm biased towards the first position; an elongate guide member supported adjacent the first arm at a first end of the guide, the guide extending to a second end that is distal from the first arm and mounting point, the elongate guide including a rope support formed at the second distal end of the elongate guide member for supporting the tow rope at the second end of the elongate guide member. The first arm is moved from the first stowed position to the second deployed position when the tow rope is pulled taut during surfing behind the boat such that the elongate guide aligned along a length of the taut tow rope.

In one embodiment, the tow rope management system further includes a second arm attached between the elongate guide member and the first arm, the second arm pivotable along a vertical axis. In another embodiment, the elongate guide member has greater resiliency in a vertical direction along a length of the elongate guide member than a horizontal direction of the elongate guide member.

In yet another embodiment, the first arm is biased towards the first position with a first spring, the spring attached at a first end to the first arm and at a second end to a mount fixed adjacent the mounting point. In one embodiment, the elongate guide member is upwardly biased with a second spring mounted at a first end to the elongate guide member and at a second end to the first arm. In another embodiment, the first arm is pivotally attached to a tower structure of the boat.

In a second aspect, a tow rope management system for managing a tow rope is attached to a mounting point on a boat and includes: a first arm pivotally associated with the boat adjacent the mounting point on the boat, the first arm pivotable along a horizontal axis between a first stowed position and a second deployed position, the first arm biased towards the first position; a second arm pivotable along a vertical axis between upward and downward positions, the second arm pivotally attached to the first arm; an elongate guide member attached to the second arm at a first end of the guide member, the elongate guide member to a second end that is distal from the second arm and mounting point; the elongate guide including a rope support formed at the second distal end of the elongate guide member for supporting the tow rope at the second end of the elongate guide member.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
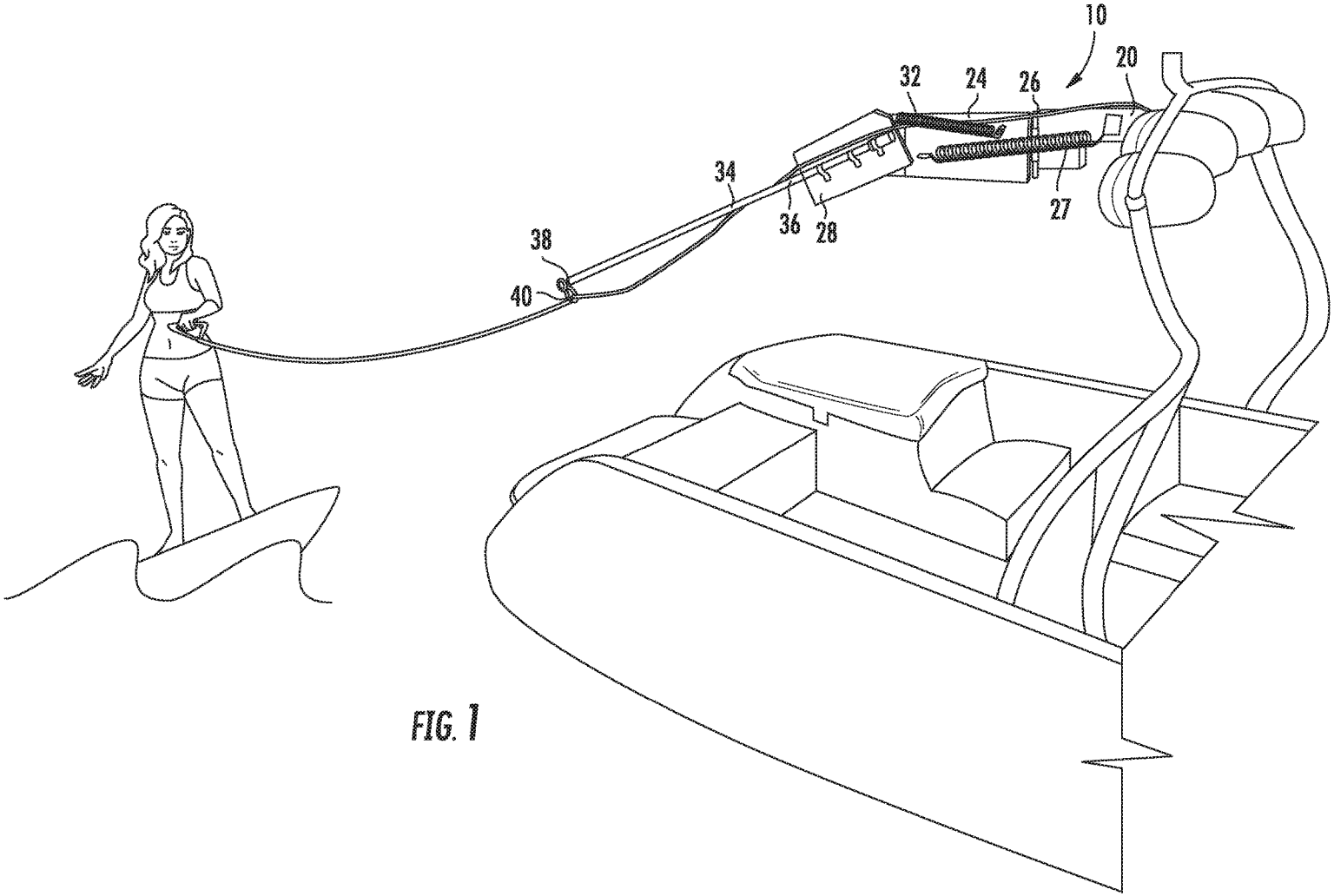
FIG. 1 shows a tow rope management device in a deployed position according to one embodiment of the present disclosure.
Figure 2:
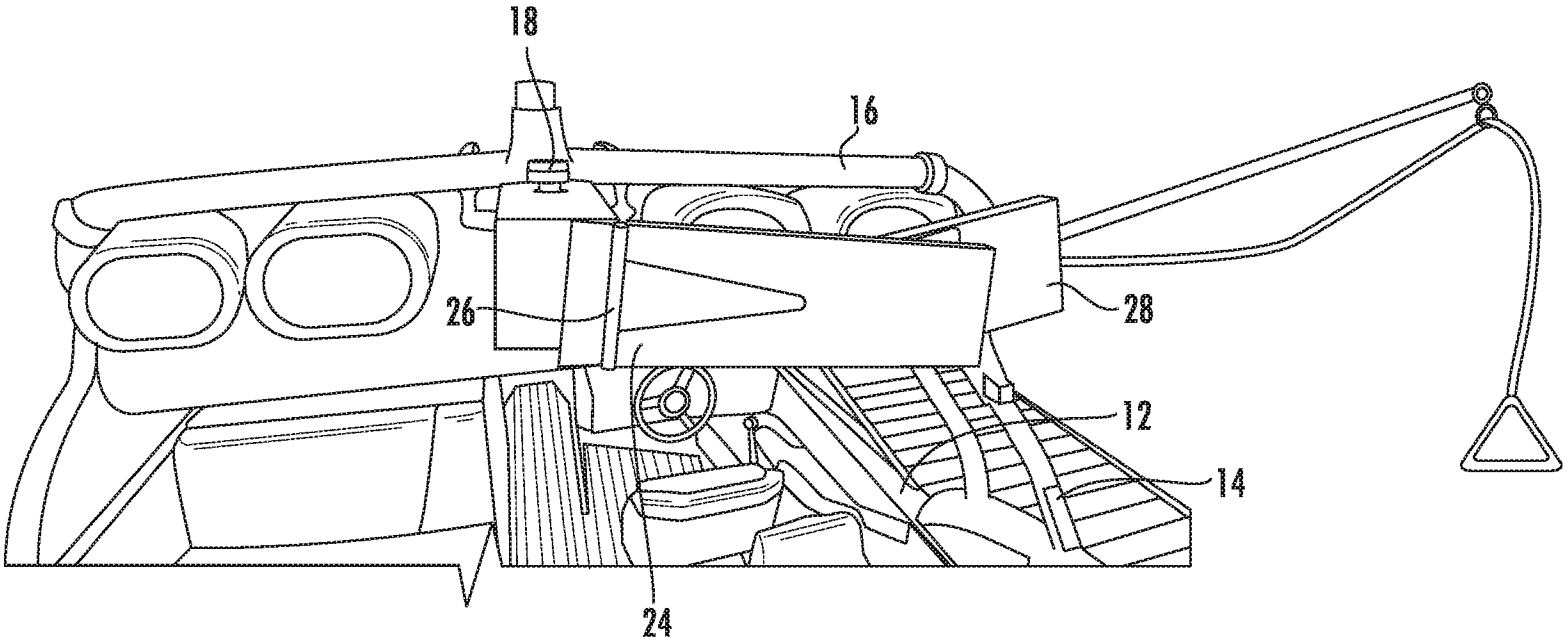
FIG. 2 shows a tow rope management device in a stowed position according to one embodiment of the present disclosure.

FIG. 1 shows a basic embodiment of a wake tower tow rope management device 10 for managing a tow rope behind a boat during wake surfing and other water activities. The tow rope management device 10 is mounted on a boat 12, such as on a wake tower 14 (FIG. 2) or other structure of the boat 12. The tower 14 includes a tower cross-member 16 and a tow point 18 formed on the tower cross member 16. The tow point 18 is shaped to receive a tow rope, such as a wake surf rope, around the tow point 18 for pulling a user behind the boat 12.

Figure 3:
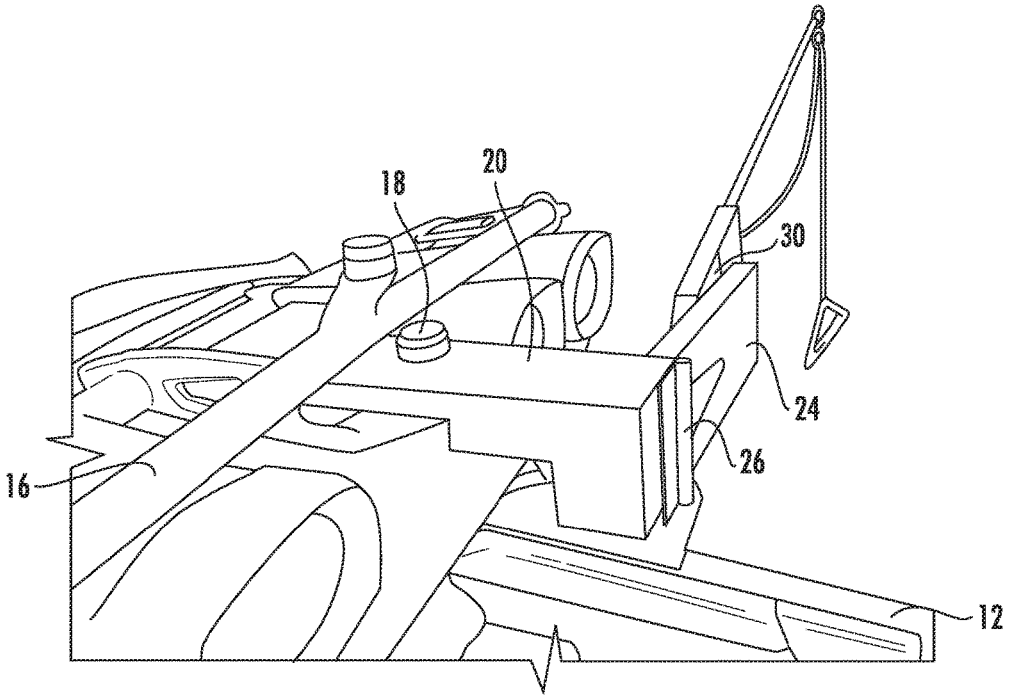
FIG. 3 shows a side view of a tow rope management device in a stowed position according to one embodiment of the present disclosure.
Figure 4:
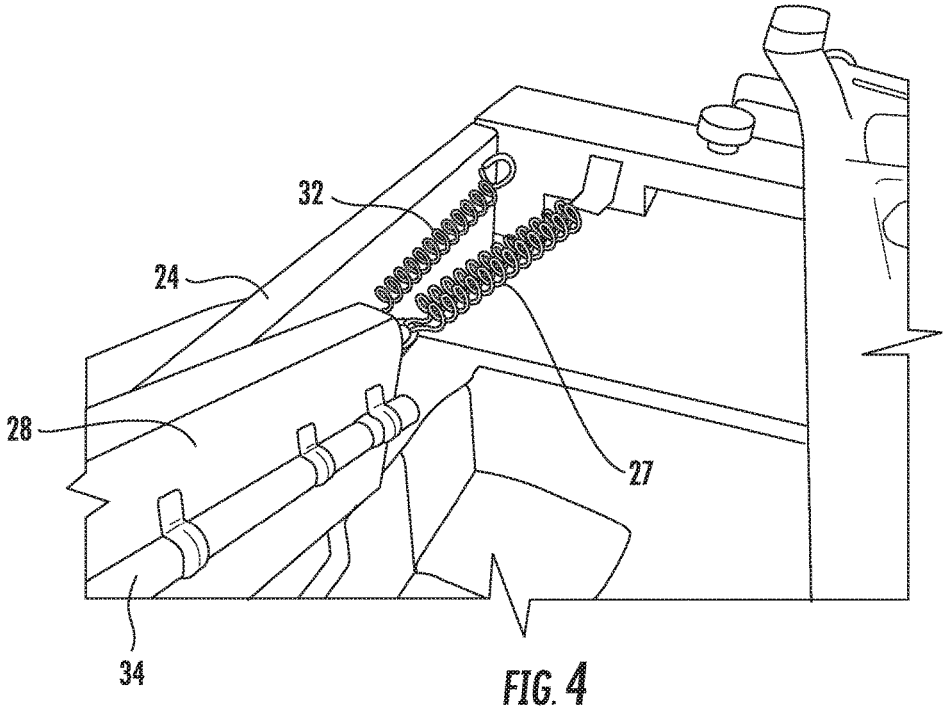
FIG. 4 shows a rear view of a tow rope management device in a stowed position according to one embodiment of the present disclosure.

Referring now to FIG. 3, the tow rope management device 10 is mounted to the wake tower 14 of the boat 12 with a base 20. The base 20 is associated with the wake tower 14 such that the base 20 is secured on the wake tower 14 during use of the wake tower 14, such as when a user is wake surfing behind the boat 12. The base 20 is preferably mounted to the boat 12 at the tow point 18. For example, as shown in FIG. 3, the base 20 may include a bore 22 formed through the base 20 such that the base 20 fits over and around the tow point 18. Alternatively, the base 20 may be attached to the wake tower 14, such as by clamping the base 20 to the cross-member 16 of the wake tower 14 or other structural components of the wake tower 14.

Referring again to FIG. 1, a first arm 24 is pivotally attached to the base 20. The first arm 24 is attached with a hinge 26 and is movable between first and second positions. The first arm 24 is pivotable along a horizontal axis between the first and second positions. In a first position (FIGS. 2 and 3), the first arm is oriented substantially perpendicular to a longitudinal axis of the boat 12. When the first arm 24 is in the first position, the rope management device 10 is substantially stowed such that a tow rope is maintained towards either the starboard or port sides of the boat when a user is not holding the tow rope. In the second position (FIG. 1), the first arm 24 is preferably aligned with the longitudinal axis of the boat 12 and is preferably aligned with the tow rope when the tow rope is pulled taut by a user behind the boat 12.

The first arm 24 is preferably biased towards the first position with a biasing mechanism. The biasing mechanism preferably comprises a first spring 27 attached between the first arm 24 and the base 20. While FIG. 1 shows the biasing mechanism as a spring, it is also understood that various other biasing mechanisms may be suitable to make the first arm 24 biased towards the first position. For example, a gas spring or other suitable mechanism bias the first arm 24 towards the first position. In one embodiment, a damper is also positioned between the first arm 24 and the base 20 to dampen movement of the first arm 24 between the first position and the second position.

A second arm 28 is pivotally associated with the first arm 24, the second arm 28 pivotable along a vertical axis such that the second arm 28 pivots vertically between upper and lower positions. The second arm 28 is preferably attached to the first arm 24 with a pivot 30. The second arm 28 rotates about the pivot 30 along a plane perpendicular to the pivot direction of the first arm 24. The second arm 28 is preferably biased towards the upper position, as shown in FIG. 3. The second arm 28 is biased towards the upper position with a second bias mechanism, such as a second spring 32 located between the second arm 28 and the first arm 24. A damper may also be located between the second arm 28 and the first arm 24 to dampen movement of the second arm 28 between the upper and lower positions.

While reference is made above to the first arm 24 and second arm 28, it is also understood that embodiments of the tow rope management device 10 may include the first arm 24 and second arm 28 formed as a single piece. For example, in one embodiment the tow rope management device 10 may include only a single arm, and the single arm may include a pivot that allows the single arm to move in both lateral and vertical directions.

An elongate guide member 34 is attached to the second arm 28 and extends from a first end 36 adjacent the second arm 28 to a second end 38 distal from the first end 36 and tow point 18. The elongate guide member 34 is resiliently flexible along a length of the elongate guide member 34 such that the second end 38 of the elongate guide member 34 is capable of deflecting relative to the first end 36 of the elongate guide member 34. The elongate guide member 34 may be cylindrical in shape such that the guide member 34 is capable of deflecting along both vertical and horizontal axes. In one embodiment, the elongate guide member 34 has a flattened shape such that the elongate guide member 34 is capable of deflecting in a vertical direction while retaining stiffness in a horizontal direction. The elongate guide member 34 includes one or more rope supports 40 located along a length of the elongate guide member 34 for supporting the tow rope along the length of the elongate guide member. At least one of the rope supports 40 is preferably located at the second end 38 of the elongate guide member 34.

Figure 5:
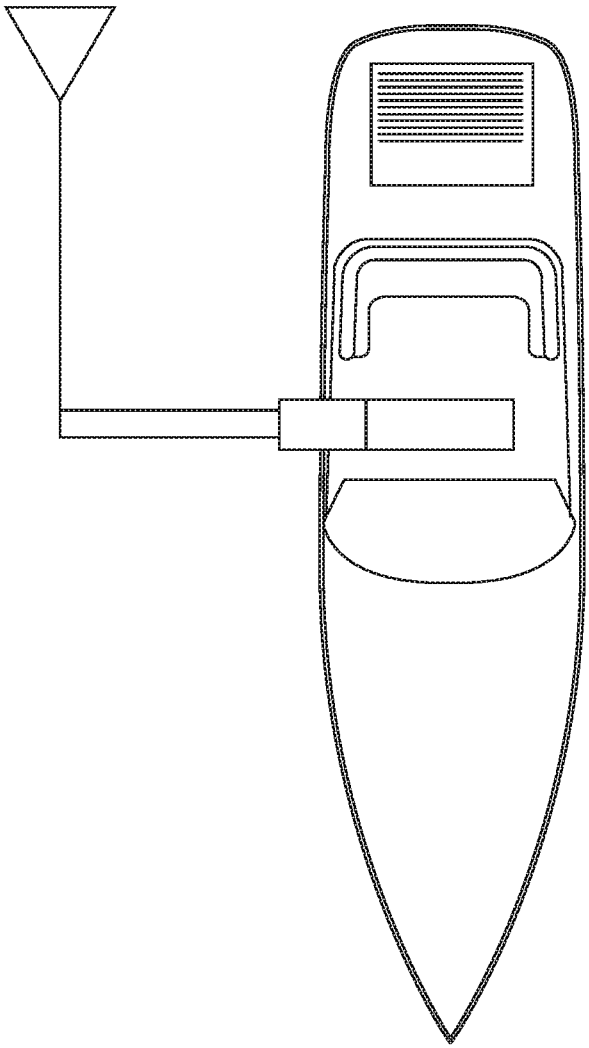
FIG. 5 shows a top view of a tow rope management device in a stowed position according to one embodiment of the present disclosure.
Figure 6:
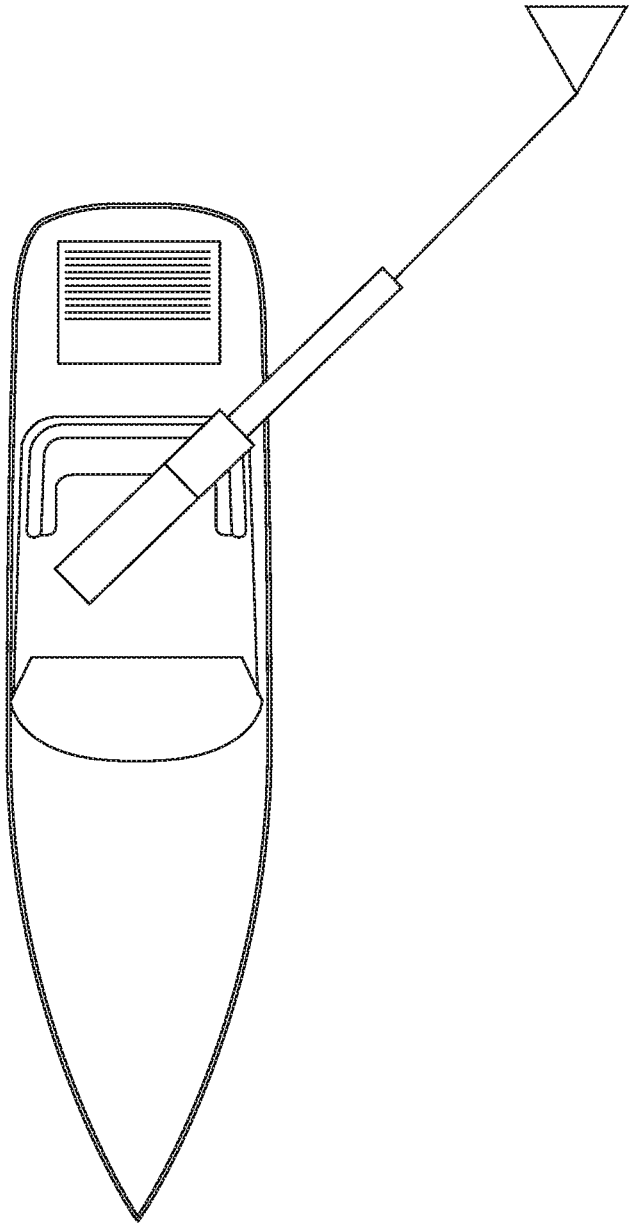
FIG. 6 shows a top view of a tow rope management device in a deployed position according to one embodiment of the present disclosure.

Referring now to FIGS. 5 and 6, the tow rope management device 10 moves between stowed and deployed positions to manage a tow rope 42 behind the boat 12 depending on whether a user is holding the tow rope 42 to surf behind the boat. The tow rope management device 10 is shown in the stowed position in FIG. 5. In the stowed position, the tow rope 42 is maintained alongside the boat 12 and away from the stern of the boat 12 where a user may be surfing behind the boat 12. When a user is not holding the tow rope 42 and the tow rope 42 is slack, the biased first arm and biased second arm maintain the tow rope management device 10 in the stowed position shown in FIG. 5.

When a user grasps the tow rope 42 and the tow rope becomes taut, the tow rope management device 10 moves from the stowed position of FIG. 5 to the deployed position of FIG. 6. As the tow rope 42 becomes taut, the elongate guide member 34 is aligned with a length of the taut tow rope 42 between the tow point 18 and a distal end 44 of the tow rope 42. When a user releases the tow rope 42, such as when the user is surfing a wake behind the boat 12 and no longer requires the tow rope 42, the tow rope management device 10 urges the elongate guide member 34 and tow rope 42 to return to the stowed position such that the tow rope 42 does not interfere with the user surfing behind the boat 12.

Figure 7:
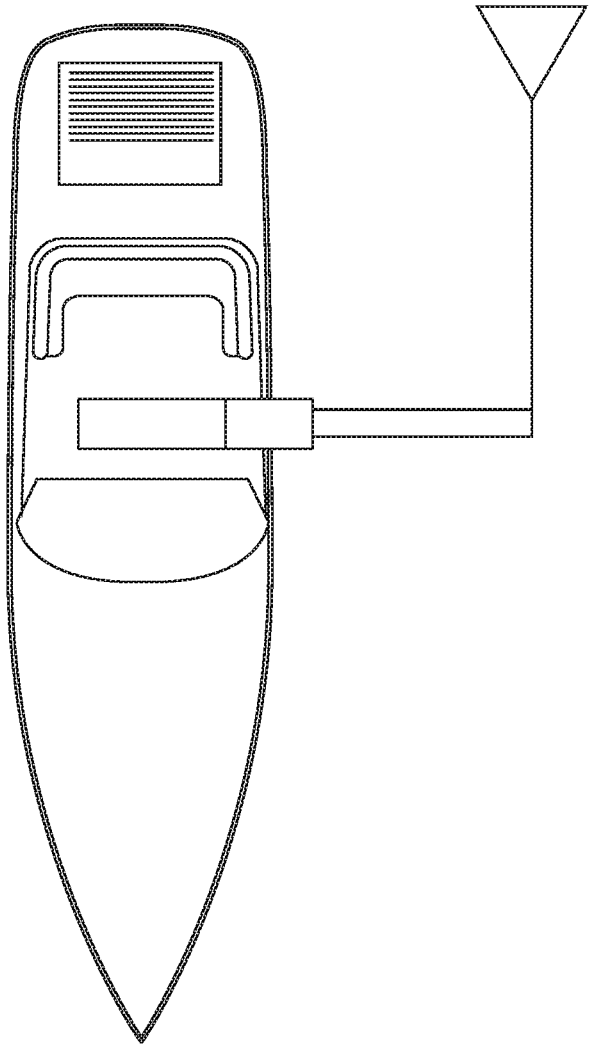
FIG. 7 shows a top view of a tow rope management device in a stowed position according to one embodiment of the present disclosure.

While FIGS. 5 and 6 show the tow rope management device 10 oriented towards a starboard side of the boat 12 when in the stowed position, it is also understood that the tow rope management device 10 may be mounted such that the stowed position is towards the port side of the boat 12. In one embodiment, the base 20 is mounted to the wake tower 14 with a pivot such that the tow rope management device 10 may be flipped from a starboard side to a port side and vice versa. As shown in FIG. 6, in a deployed position the tow rope management device 10 may be angled relative to a center line of the boat 12 to allow a user to be positioned along either a starboard or port wake of the boat 12. Referring to FIG. 7, in one embodiment the tow rope management device 10 may pull the tow rope 42 towards a port side of the boat 12 depending on a side of the boat 12 on which a user desires to surf.

While the above description describes attachment of the tow rope management device 10 to a wake tower, it is also understood that the tow rope management device 10 may be attached to other structures of a boat such that the device is associated with a tow rope attached to the boat. For example, the tow rope management device 10 may be attached to a hull, deck, swim platform, or other areas of the boat.

The tow rope management device 10 of the present disclosure advantageously manages a position of the tow rope 42 behind the boat 12 such that the tow rope is maintained away from the user when the user is surfing a wake behind the boat 12. Further, the tow rope management device 10 safely maintains the tow rope 42 away from a side of the boat 12 to allow a user to grab the rope without requiring a driver of the boat to maneuver closely to the user. The tow rope management device 10 is readily installed on existing boats including wake towers.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A tow rope management system for managing a tow rope attached to a mounting point on a boat, the tow rope management system comprising:

a first arm pivotally associated with the boat adjacent the mounting point on the boat, the first arm pivotable along a horizontal axis between a first stowed position and a second deployed position, the first arm biased towards the first position;

an elongate tow rope guide member supported adjacent the first arm at a first end of the guide, the elongate tow rope guide extending to a second end that is distal from the first arm and mounting point, the elongate tow rope guide including a rope support formed at the second end of the elongate tow rope guide member that is distal from the first arm and mounting point for supporting the tow rope at the second end of the elongate guide member;

wherein the first arm is moved from the first stowed position to the second deployed position when the tow rope is pulled taut during surfing behind the boat such that the elongate guide aligned along a length of the taut tow rope.

2. The tow rope management system of claim 1, further comprising a second arm attached between the elongate guide member and the first arm, the second arm pivotable along a vertical axis.

3. The tow rope management system of claim 1, wherein the elongate guide member has greater resiliency in a vertical direction along a length of the elongate guide member than a horizontal direction of the elongate guide member.

4. The tow rope management system of claim 1, wherein the first arm is biased towards the first position with a first spring, the spring attached at a first end to the first arm and at a second end to a mount fixed adjacent the mounting point.

5. The tow rope management system of claim 1, wherein the elongate guide member is upwardly biased with a second spring mounted at a first end to the elongate guide member and at a second end to the first arm.

6. The tow rope management system of claim 1, wherein the first arm is pivotally attached to a tower structure of the boat.

7. A tow rope management system for managing a tow rope attached to a mounting point on a boat, the tow rope management system comprising:

a first arm pivotally associated with the boat adjacent the mounting point on the boat, the first arm pivotable along a horizontal axis between a first stowed position and a second deployed position, the first arm biased towards the first position;

a second arm pivotable along a vertical axis between upward and downward positions, the second arm pivotally attached to the first arm;

an elongate guide member attached to the second arm at a first end of the guide member, the elongate guide member to a second end that is distal from the second arm and mounting point; the elongate guide including a rope support formed at the second distal end of the elongate guide member for supporting the tow rope at the second end of the elongate guide member.

8. The tow rope management system of claim 7, wherein the elongate guide member has greater resiliency in a vertical direction along a length of the elongate guide member than a horizontal direction of the elongate guide member.

9. The tow rope management system of claim 7, wherein the first arm is biased towards the first position with a first spring, the spring attached at a first end to the first arm and at a second end to a mount fixed adjacent the mounting point.

10. The tow rope management system of claim 7, wherein the elongate guide member is upwardly biased with a second spring mounted at a first end to the elongate guide member and at a second end to the first arm.

11. The tow rope management system of claim 7, wherein the first arm is pivotally attached to a tower structure of the boat.

12. A tow rope management system for managing a tow rope attached to a mounting point on a boat, the tow rope management system comprising:

a first arm pivotally associated with the boat adjacent the mounting point on the boat, the first arm pivotable along a horizontal axis between a first stowed position and a second deployed position, the first arm biased towards the first position with a first spring, the spring attached at a first end to the first arm and at a second end to a mount fixed adjacent the mounting point;

a second arm pivotable along a vertical axis between upward and downward positions, the second arm pivotally attached to the first arm;

an elongate guide member attached to the second arm at a first end of the guide member, the elongate guide member to a second end that is distal from the second arm and mounting point; the elongate guide including a rope support formed at the second distal end of the elongate guide member for supporting the tow rope at the second end of the elongate guide member, wherein the elongate guide member has greater resiliency in a vertical direction along a length of the elongate guide member than a horizontal direction of the elongate guide member.

* * * * *